United States Patent [19]

Hoonsbeen et al.

[11] Patent Number: 4,913,020

[45] Date of Patent: Apr. 3, 1990

[54] ILLUMINATED FILM CUTTER AND BASE

[75] Inventors: Gary A. Hoonsbeen; John R. Mattson, both of Minneapolis, Minn.

[73] Assignee: Image Innovations, Inc., Edina, Minn.

[21] Appl. No.: 300,593

[22] Filed: Jan. 23, 1989

[51] Int. Cl.[4] ..... B26D 1/18

[52] U.S. Cl. ..... 83/471.2; 83/508; 83/520; 83/614

[58] Field of Search ..... 83/520, 521, 614, 485, 83/487, 488, 489, 490, 648, 505, 508, 345, 347, 455, 471.2

[56] References Cited

U.S. PATENT DOCUMENTS

| | | | |
|---|---|---|---|
| 3,410,994 | 11/1968 | Facto | 83/520 |
| 3,532,018 | 10/1970 | Szabo | 83/520 |
| 3,628,412 | 12/1971 | Rogers, Jr. | 83/508 |
| 3,704,067 | 11/1972 | Womack | 83/520 |
| 4,086,835 | 5/1978 | Frederick | 83/488 |
| 4,503,740 | 3/1985 | Brand et al. | 83/520 |
| 4,769,747 | 9/1988 | Parrillo | 83/520 |

FOREIGN PATENT DOCUMENTS

| | | | |
|---|---|---|---|
| 711331 | 6/1954 | United Kingdom | 83/520 |

*Primary Examiner*—Frank T. Yost
*Assistant Examiner*—Scott A. Smith
*Attorney, Agent, or Firm*—John W. Adams

[57] ABSTRACT

A film cutter which includes a supporting frame structure with a translucent supply side platform mounted thereon and adapted to be illuminated by an underlying light source and including a film cutter mounted on the frame structure.

7 Claims, 2 Drawing Sheets

ILLUMINATED FILM CUTTER AND BASE

BACKGROUND OF THE INVENTION

In the past, transparency film cutters have been relatively difficult to operate and close tolerance trimming and cutting have been relatively difficult and time consuming. None of the cutters presently in use permit viewing of the transparency during the positioning and cutting operation.

SUMMARY OF THE INVENTION

The present invention provides an illuminated supporting platform which permits quick and easy viewing and positioning of the transparent filmstrip to be trimmed. A cutter unit is slidably mounted on a rigid guide bar which is permanently aligned with the cutting edge of a translucent viewing and positioning platform to facilitate accurate positioning of the transparency strip for trimming thereof. It is particularly important that the precise selected cut line of the transparency can be quickly and easily positioned at the cutting edge of the platform so that the operator may view the transparent strip and the area to be trimmed. The present construction includes a translucent illuminated "supply" side platform which overlaps a portion of the "off-cut" side platform located below the cutting edge portion of the supply side platform. This provides reinforcing strength and rigidity to the overlying cutting edge of the supply side platform and also prevents the trimmed material from falling into the area below the two platforms. In addition, the cutting edge formed by the supply side platform is aligned with the path of the cutter blade and is provided with a relief edge portion in the lower portion of the cutter path to minimize damage to the cutter blade and also to the cutting edge of the platform.

DETAILED DESCRIPTION OF THE PREFERRED EMBODIMENT

Figure 1:
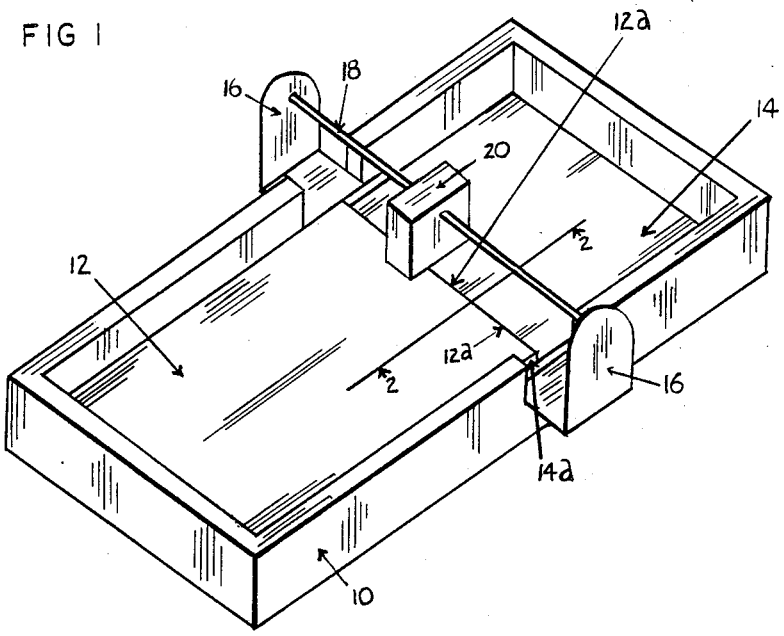
FIG. 1 is a perspective view of a film cutter embodying this invention.

As best shown in FIG. 1, a supporting frame 10 is provided in which a translucent supply side platform 12 is rigidly mounted. A light source (not shown in FIG. 1) is provided under the platform 12. The platform 12 may be square in shape and removably mounted within the frame 10 to permit all four sides or edges thereof to be used as a cutting edge **12*a***. Also since only the "top" edge forms the cutting edge, the platform may be inverted to provide a total of eight cutting edges.

A second platform 14 is rigidly mounted within the frame 10 with one edge portion thereof underlying the marginal edge portion of supply side platform 12 adjacent to the cutting edge **12*a* thereof to provide reinforcement for the overlapping marginal edge portion of platform 12. The reinforcing marginal edge portion of platform 14 which underlies the marginal edge portion of platform 12 is designated by the reference character 14*a***.

A pair of cutter bar supporting brackets 16 are rigidly mounted to the edge portions of the frame 10 and positively anchor a cutter transfer bar 18 in overlying spaced relation above the cutting edge **12*a*. A cutter slide 20 is slidably mounted on the bar 18 for back and forth travel thereon and a cutter wheel 22 is rotatably mounted on a spindle 23 rigidly supported on the cutter slide 20. In order to minimize damage to the cutter edge 12*a* of the platform 12, a relief recess 12*b* is formed in the cutter edge 12*a* of said platform to minimize frictional engagement between the peripheral cutting edge 22*a* of the cutter 22**.

Figure 2:
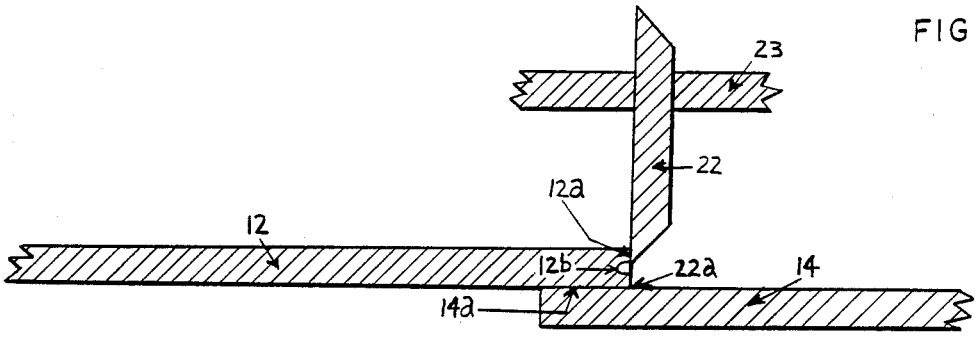
FIG. 2 is a fragmentary vertical sectional view taken substantially along the line 2—2 of FIG. 1.
Figure 3:
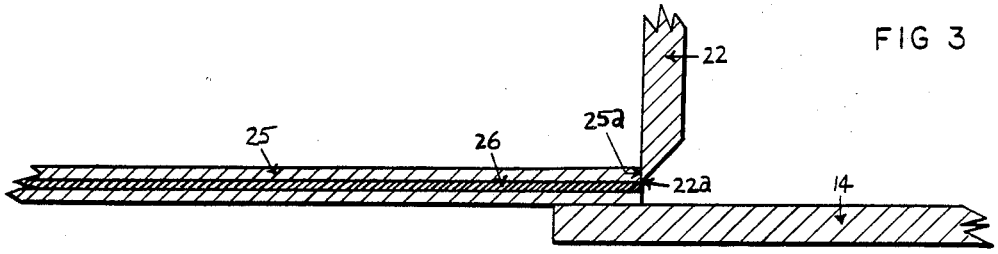
FIG. 3 is a vertical sectional view similar to FIG. 2, but showing an alternative cutting edge construction.

An alternative supply side platform 25 is illustrated in FIG. 3 wherein a layer of relatively soft material 26 is laminated into the cutter platform 25 which has a cutting edge **25*a*. The relatively soft laminated layer 26 serves the same general function as the relief recess 12*b* by protecting the peripheral cutting edge 22*a* of the cutter 22. An off-cut platform 14 is provided which is similar to the off-cut platform 14 shown in FIG. 2**.

Figure 4:
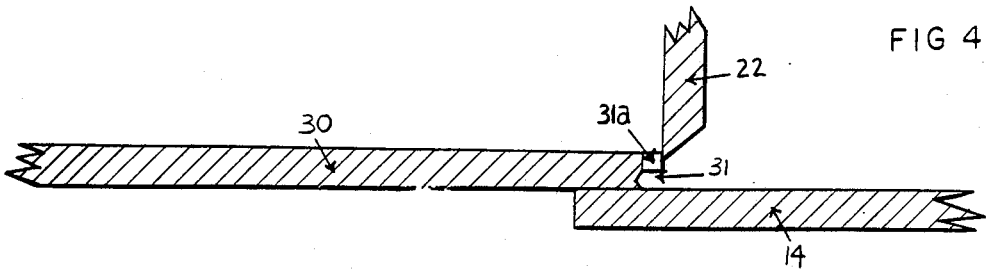
FIG. 4 is a similar vertical sectional view to FIG. 3 but showing another modified cutting edge construction.
Figure 5:
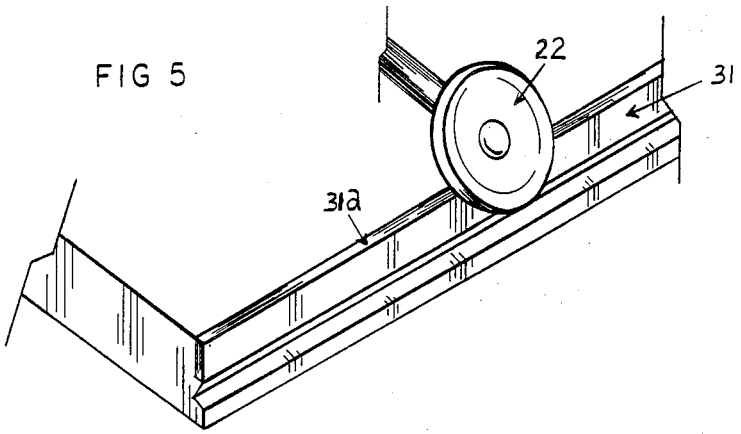
FIG. 5 is a fragmentary perspective view of a portion of a cutter showing the modified cutting edge illustrated in FIG. 4.

In the form shown of the invention shown in FIG. 4, a supply side platform 30 is provided wherein a hardened steel alloy strip 31 is fused or permanently bonded to the edge of the platform 12 adjacent to the cutting path of the cutter wheel 22. The strip 31 forms a cutting edge **31*a* for the transparency film being cut. An off-cut platform 14** is also provided as in the other forms of the invention.

The platform 25 may be provided with a guide or marker grid to assist an operator to position a film transparency quickly and accurately thereon.

Figure 6:
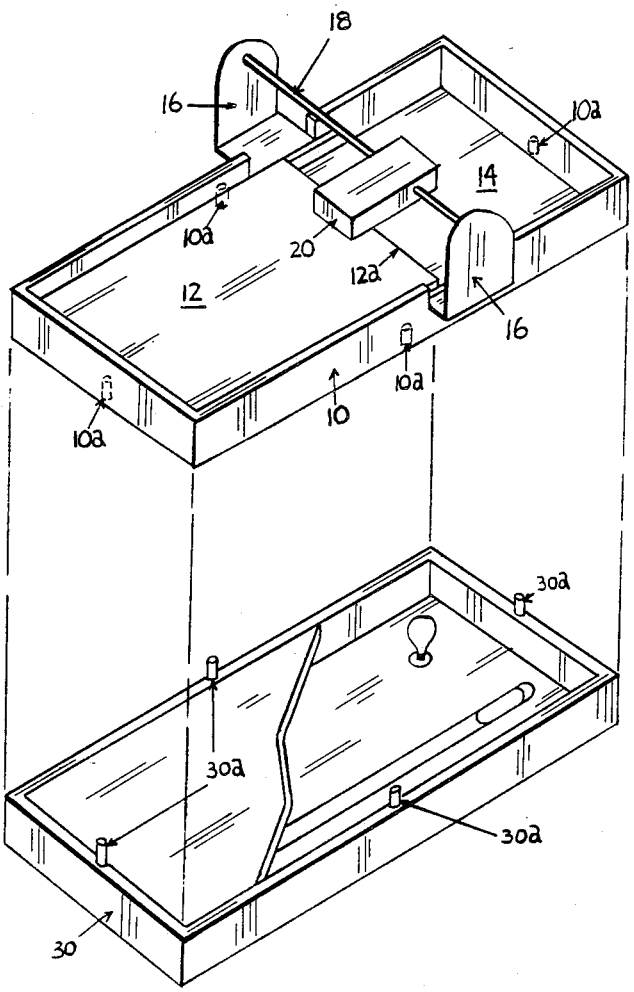
FIG. 6 is a perspective view showing the frame removably mounted to the base.

FIG. 6 shows a separate illuminating base section 30 on which the frame 10 can be removably mounted. The frame 10 has a plurality of openings **10*a* which register with upstanding pins 30*a* provided in the upper edge of the base section 30** to hold the two sections together.

What is claimed is:

1. An illuminated film cutter and base unit comprising, a rigid frame structure, a translucent supply side supporting platform removably mounted to said frame structure for supporting a transparent filmstrip to be trimmed and having an integrally formed translucent cutting edge between top and bottom surfaces of said supply side supporting platform for forming a precise cut line for a filmstrip positioned thereon, said supply side supporting platform and frame structure being adapted to overly an illuminating light source to facilitate viewing and positioning of the filmstrip on the platform, a circular film cutter mounted on said frame structure and disposed in precise alignment with the cutting edge of said supply side supporting platform and having a peripheral edge extending below the top surface of said supply side supporting platform for cutting a filmstrip along the cutting edge of the supply side supporting platform, and including an illuminating light source attached to the frame structure in underlying relation to the supply side supporting platform.

2. The structure set forth in claim 1 and a translucent off-cut platform mounted on said frame structure and extending outwardly beyond the supply side supporting platform to receive material cut off by the cutter.

3. The structure set forth in claim 2 wherein the off-cut platform includes a portion thereof which underlies the cutting edge of said supply side supporting platform to provide support therefor.

4. The structure set forth in claim 1 wherein the cutting edge of the supply side supporting platform includes cutter protective means to reduce cutter wear.

5. The structure set forth in claim 4 wherein the cutter protective means comprises a lamination in the supply side supporting platform intermediate the top and bottom surfaces of said supply side supporting platform to receive and cushion the peripheral edge of the cutter extending below said top surface of said supply side supporting platform during the cutting operation.

6. The structure set forth in claim 4 wherein the cutting edge portion of the supply side supporting platform is provided with a relief recess to reduce the contact area between the cutting edge of the supply side supporting platform and the cutter to minimize frictional wear of the cutter.

7. The structure set forth in claim 1, wherein said supply side platform comprises a plurality of translucent cutting edges formed around the periphery thereof such that repositioning of said supply side platform with respect to said frame will allow said cutter to cooperate with each one of said plurality of cutting edges.

* * * * *